United States Patent [19]

Rolfe

[11] 4,033,496

[45] July 5, 1977

[54] APPARATUS FOR HAULING CABLES OR OTHER ELONGATE BODIES

[75] Inventor: Hugh Hieron Rolfe, Harlow, England

[73] Assignee: The Post Office, London, England

[22] Filed: Jan. 7, 1976

[21] Appl. No.: 647,145

[30] Foreign Application Priority Data

Jan. 13, 1975 United Kingdom ..... 1406/75

[52] U.S. Cl. ..... 226/188; 226/176; 226/187

[51] Int. Cl.[2] ..... B65H 17/12

[58] Field of Search ..... 226/108, 176, 177, 181, 226/186, 187, 189, 195, 188; 254/138, 175.5

[56] References Cited

UNITED STATES PATENTS

| | | | |
|---|---|---|---|
| 3,288,337 | 11/1966 | Bergen et al. | 226/181 |
| 3,390,532 | 7/1968 | Lawrence | 226/108 UX |
| 3,715,068 | 2/1973 | Clarke et al. | 226/108 |
| 3,833,162 | 9/1974 | Sato | 226/187 X |

*Primary Examiner*—Robert W. Saifer
*Attorney, Agent, or Firm*—Hall & Houghton

[57] ABSTRACT

In an apparatus for hauling a cable or other elongate body, the cable or other body is gripped between a plurality of pairs of traction wheels, each pair being mounted tandem fashion relative to the other pair of pairs. The wheels of each pair are resiliently biased into contact with the cable and at least one of each pair of wheels is driven by its own motor. A mechanical coupling is provided constraining one wheel of one pair to rotate conjointly with one wheel of another pair.

In one embodiment the apparatus includes two pairs of traction wheels, each wheel being driven by a respective motor. The wheels on each side of the cable are mounted on a respective bogie. The bogies are carried on supports to move the wheels towards and away from the cable path and the wheels are resiliently biased into contact with the cable by an hydraulic jack connected from one support to the other.

17 Claims, 6 Drawing Figures

APPARATUS FOR HAULING CABLES OR OTHER ELONGATE BODIES

This invention relates to apparatus for hauling cables or other elongate bodies.

British Patent Specification No. 1,315,664 describes a cable engine for the laying or recovery of cables at sea and whilst that cable engine is very satisfactory for its intended purpose, there exist other cable hauling applications for which it is not particularly suitable. As is well known, the cable aboard cable-laying ships is stowed as a continuous length in large cylindrical holds called cable tanks and whilst laying of a cable takes place continuously, it is usual to withdraw the cable from storage by hauling out a length of the continuous cable and using most of that length before hauling out any more. There exists therefore a need for a cable engine to deal with the hauling of cable to withdraw it from a tank, or conversely to help in stowing cable in a tank. Such a cable engine suitable for use in withdrawing or stowing cable, but not primarily intended for use in laying or recovery at sea as such, will be termed here a "cable transporter". It is desirable that a cable transporter shall be able to handle equal cable tension for both directions of cable movement whereas a laying or recovery engine is usually designed to handle much higher cable tension when the pull is on the outboard side than when on the inboard side.

In the cable engine described in the British specification mentioned above, hydraulically powered traction wheels fitted with pneumatic tires are used to apply traction to a cable. The traction wheels are arranged in pairs, the respective tires of each pair contacting the cable at opposite ends of a diameter of the cable, each wheel having a respective hydraulic motor and the motors being connected in parallel. This engine is suited to handling the relatively large cable tensions involved in laying or recovery but is not very suitable for use as a "cable transporter".

It is an object of the invention to provide an improved apparatus for hauling a cable or other elongate body, particularly at very low tension.

According to the present invention there is provided an apparatus for hauling a cable or other elongate body, the apparatus including:

a plurality of pairs of traction wheels, each pair being mounted in tandem fashion relative to the other pair or pairs so as to define a path for the cable or other body, resilient wheel bias means to resiliently bias the wheels of each pair into contact with a cable or other body on opposite sides of the axis thereof, which cable or other body is therefore gripped, in use, by the wheels, a plurality of motors to drive the traction wheels, each pair of traction wheels having at least one respective motor, and a mechanical coupling constraining one wheel of one pair to rotate conjointly with one wheel of another pair.

It is preferred that a respective motor for each wheel is provided and the motors are preferably hydraulic motors connected hydraulically in parallel.

The number of pairs of wheels can be two. In this case, the mechanical coupling can comprise a first intermediate gear wheel interconnecting the two wheels on one side of said path and a second intermediate gear wheel interconnecting the two wheels on the other side of said path.

The wheels on one side of said path can be mounted on a bogie and the wheels on the other side of said path can be mounted on another bogie, the or each bogie being mounted for pivotal movement about an axis parallel to the axes of the wheels. The wheels on the or each bogie can be coplanar. Preferably, the bogies are resiliently biassed to a position in which a line through the centers of the wheels of one bogie is parallel to a line through the centres of the wheels of the other bogiel. This result can be achieved by the use of a respective torque member for each bogie. Each torque member can comprise a rubber/metal bonded bush bearing. Preferably the wheel arrangement of each bogie is symmetrical about the pivotal axis.

The or each bogie can be carried on a respective support for movement of the wheels towards and away from the path. The or each support can be pivotally mounted. The resilient wheel bias means can comprise an hydraulic jack connected from one support to the other. Means can be provided to constrain the bogies for symmetrical movement towards and away from said path and this means can comprise a member mounted for sliding movement in the plane of symmetry in respect of said symmetrical movement and connected to each support by a respective pivotally mounted link arm. An alternative means of ensuring symmetrical movement is the use of intermeshing quadrant gears.

It is preferred that the distance of the pivot axis of the or each bogie from said path be small compared with the radii of the wheels.

By way of example only, an illustrative embodiment of the invention will now be described with reference to the accompanying drawings, in which.

In the interests of clarity of illustration, the Figures are to some extent schematic and features have been omitted from some views even though shown in others.

Figure 1:
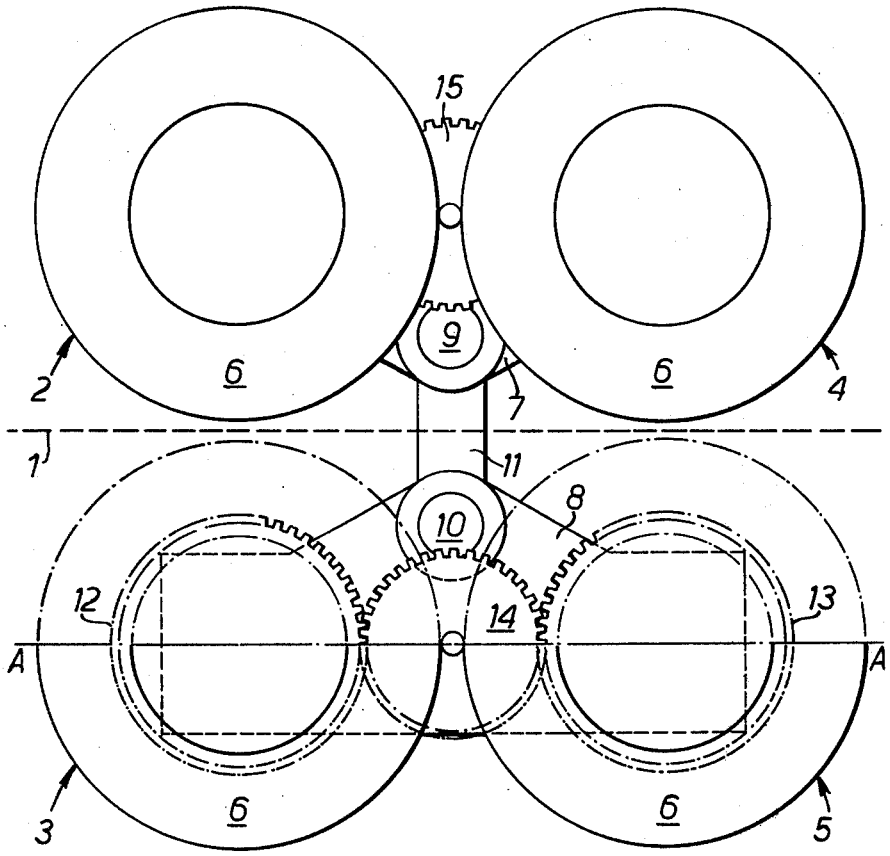
FIG. 1 shows a plan view of a cable transporter embodying the invention.

A rapid understanding of the general arrangement of the cable transporter can be obtained by referring first to the plan view, FIG. 1. The cable to be transported is not itself illustrated, but its position is shown by the axis 1. The transporter has four rotatably mounted traction wheels, 2, 3, 4 and 5. Each traction wheel is fitted with a respective pneumatic tyre 6, the wheels 2, 4 are mounted on a bogie 7 and the wheels 3, 5 on another bogie 8.

At this point, it is convenient to note that the upper half of FIG. 1 is shown in simple plan view without hidden details revealed by broken lines, whereas the lower half does show some hidden details and also includes a line A—A above which the tires are cutaway to reveal details of the mechanism.

Bogie 7 is pivotally mounted on an axle 9, and bogie 8 on an axle 10. The axles 9 an 10 are displaceable by means of a double-acting hydraulic ram 11. The wheels 2 and 3 co-operate to contact the periphery of the cable at opposite ends of a diameter thereof and likewise wheels 4 and 5 act similarly. The wheels are biassed into contact with the cable by means of the hydraulic ram 11. Wheel 3 has a gear wheel 12 fixedly attached thereto so that the wheel 3 and gear wheel 12 rotate together. Likewise, wheel 5 has a similar gear wheel 13. Gear wheels 12 and 13 both mesh with a coupling gear wheel 14 and it will therefore be clear that wheel 5 is constrained to rotate conjointly with wheel 3.

Wheels 2 and 4 are similarly provided with gear wheels and a coupling gear wheel 15 ensures that wheels 2 and 4 rotate conjointly.

Figure 2:
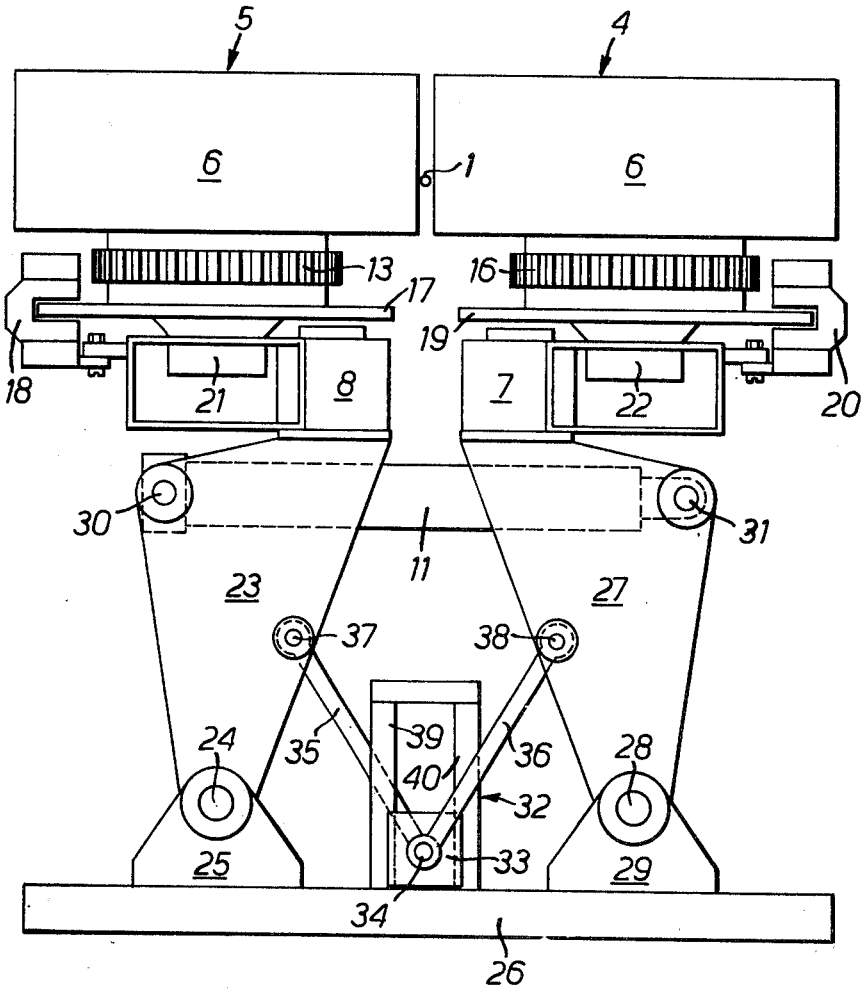
FIG. 2 shows an end-view of the transporter in an operating position.

Reference should now be made to FIG. 2, which is an end-elevation. It should first be noted that the gear wheel associated with wheel 4 has been given the reference 16.

Each of the wheels 2, 3, 4, 5 has a respective disk brake. Thus, wheel 5 carries a disk 17 which is associated with a caliper 18 and likewise wheel 4 has a disk 19 associated with caliper 20.

Each wheel is mounted on a respective hydraulic motor, that of wheel 5 being referenced 21 and that of wheel 4 being referenced 22. The motors are in turn mounted on their associated bogies. The mounting of the bogies can clearly be seen in FIG 2.

Figure 3:
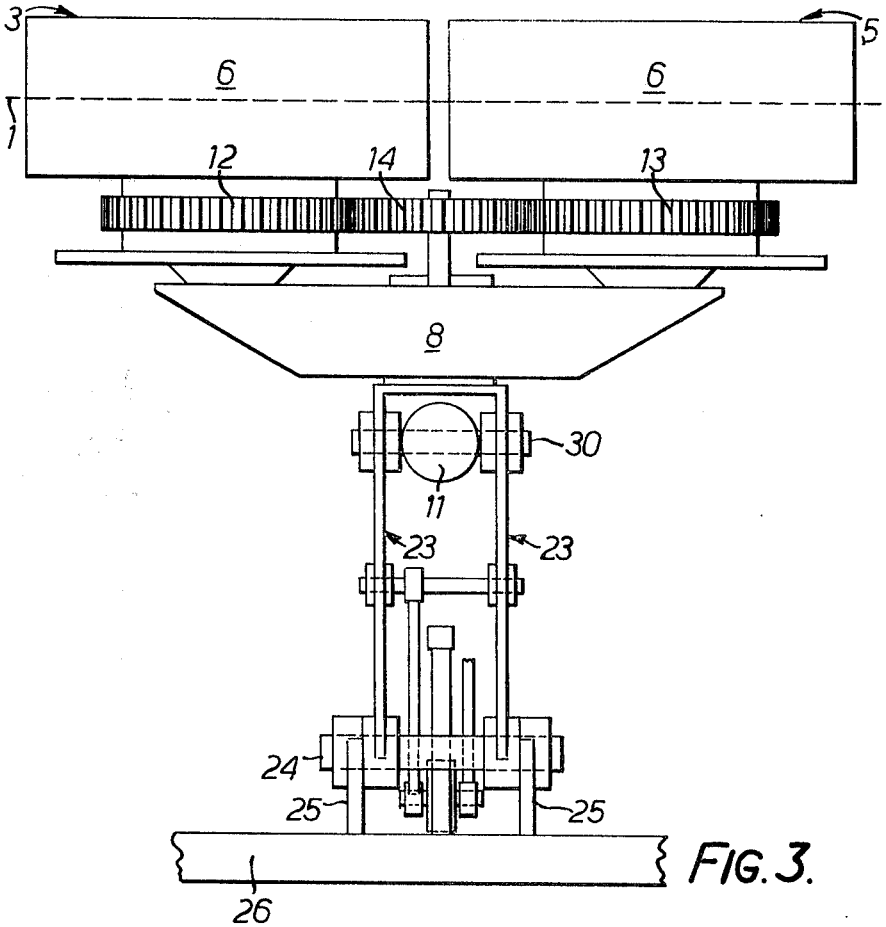
FIG. 3 shows a side elevation of the transporter.

The bogie mounting axle 10 (FIG. 1) is carried on generally triangular support plates 23 (see also FIG. 3), the lower ends of which are pivotally mounted by an axle 24 passing through brackets 25 (see also FIG. 3) on a base-board 26. Likewise, the axle 9 is carried on support plates 27 pivotally mounted by an axle 28 through brackets 29. One end of the hydraulic ram 11 is pivotally connected by a cross-bar 30 to support plates 23 and the other end is pivotally connected by a cross-bar 31 to support plates 27.

It can easily be seen from FIG. 2 that the whole assembly mounted by axle 24 can pivot about that axle and likewise the whole assembly mounted by axle 28 can pivot about that axle. The pivotal movement of the two assemblies is constrained to be symmetrical about the cable axis by means of a structure now to be described.

The structure which constrains the parts for symmetrical movement comprises a frame 32, a block 33, a cross-bar 34, connecting arms 35, 36, and cross-bars 37, 38. The frame 32 comprises two cylindrical bearings 39 and 40 up-standing from the base 26 between which the plate 33 is mounted for sliding movement. The vertical sides of the plate 33 have concave bearing surfaces mating with the convex surface of the bearing 39 and 40. The cross-bar 34 passes through the plate 33 horizontally and each end of the cross-bar pivotally mount an end of a respective one of the arms 35, 36. The other end of arm 35 is pivotally mounted on cross-bar 37 which in turn is mounted by plates 23. Similarly, arm 36 is pivotally mounted by cross-bar 38 passing through plates 27.

Figure 2A:
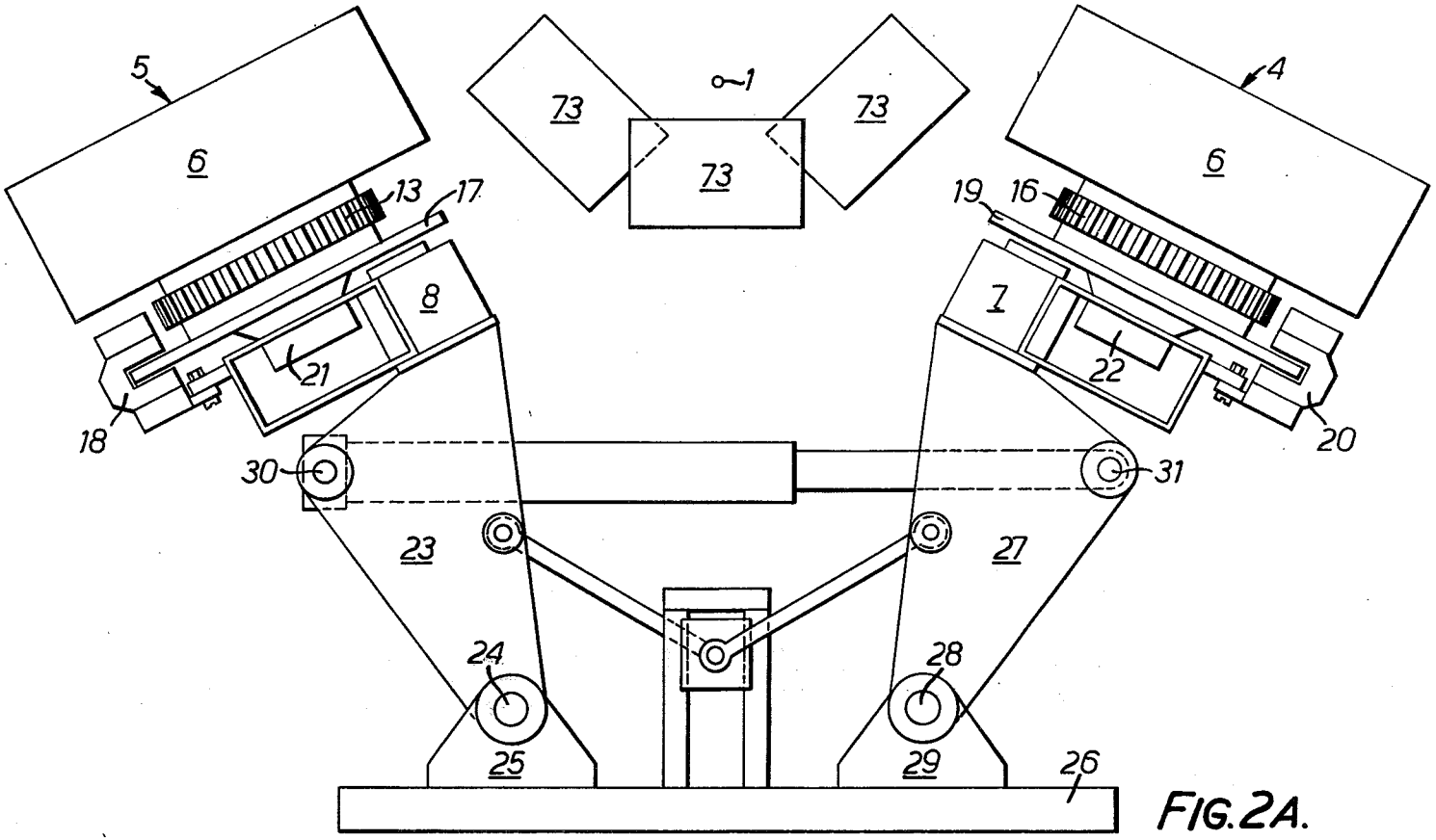
FIG. 2A shows an end-view of the transporter in a nonoperating position.

The action of the symmetrical movement mechanism can be seen by comparing FIGS. 2 and 2A, FIG. 2A showing the hydraulic ram 11 actuated so as to move the pairs of tyres away from the cable axis.

Figure 4:
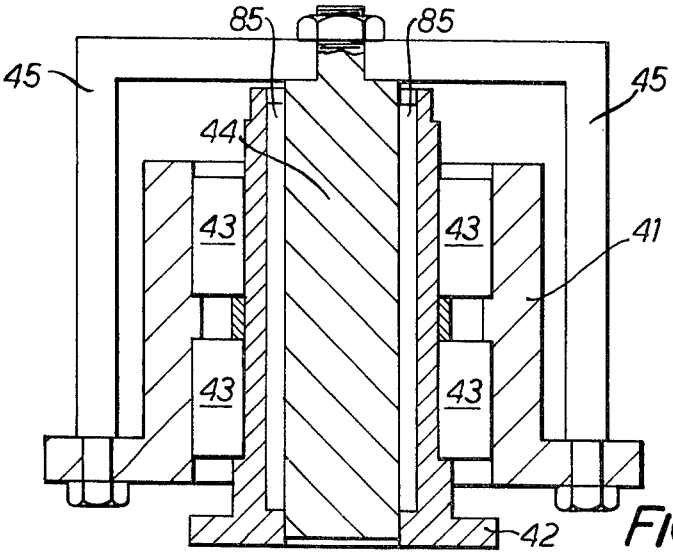
FIG. 4 shows details of a bearing used in the transporter.

The bearings 9 and 10 are each such as tend to restore the bogie position, following any pivotal movement, to that shown in FIG. 1 of the drawings. FIG. 4 shows the bearing construction and it should be noted that the bearings as seen in the other Figures are depicted quite simply without the details present in FIG. 4. The bogie (7 or 8) is fixedly attached to a hub 41 which is rotatably mounted on a member 42 by a needle bearing 43. The member 42 is fixedly mounted to the support plates (23 or 27). A cylindrical central member 44 is fixedly connected to the hub 41 by means of arms 45 and located between members 42 and 44 is a metalastik bush 85. The bush 85 has the property of exerting a restoring torque consequent upon relative rotation of the parts 42 and 44 and hence consequent upon relative rotation of parts 41 and 42. By this means, the bogies are biassed to the position shown in FIG. 1. This bias provides alignment of the bogies when the transporter is out of use.

Figure 5:
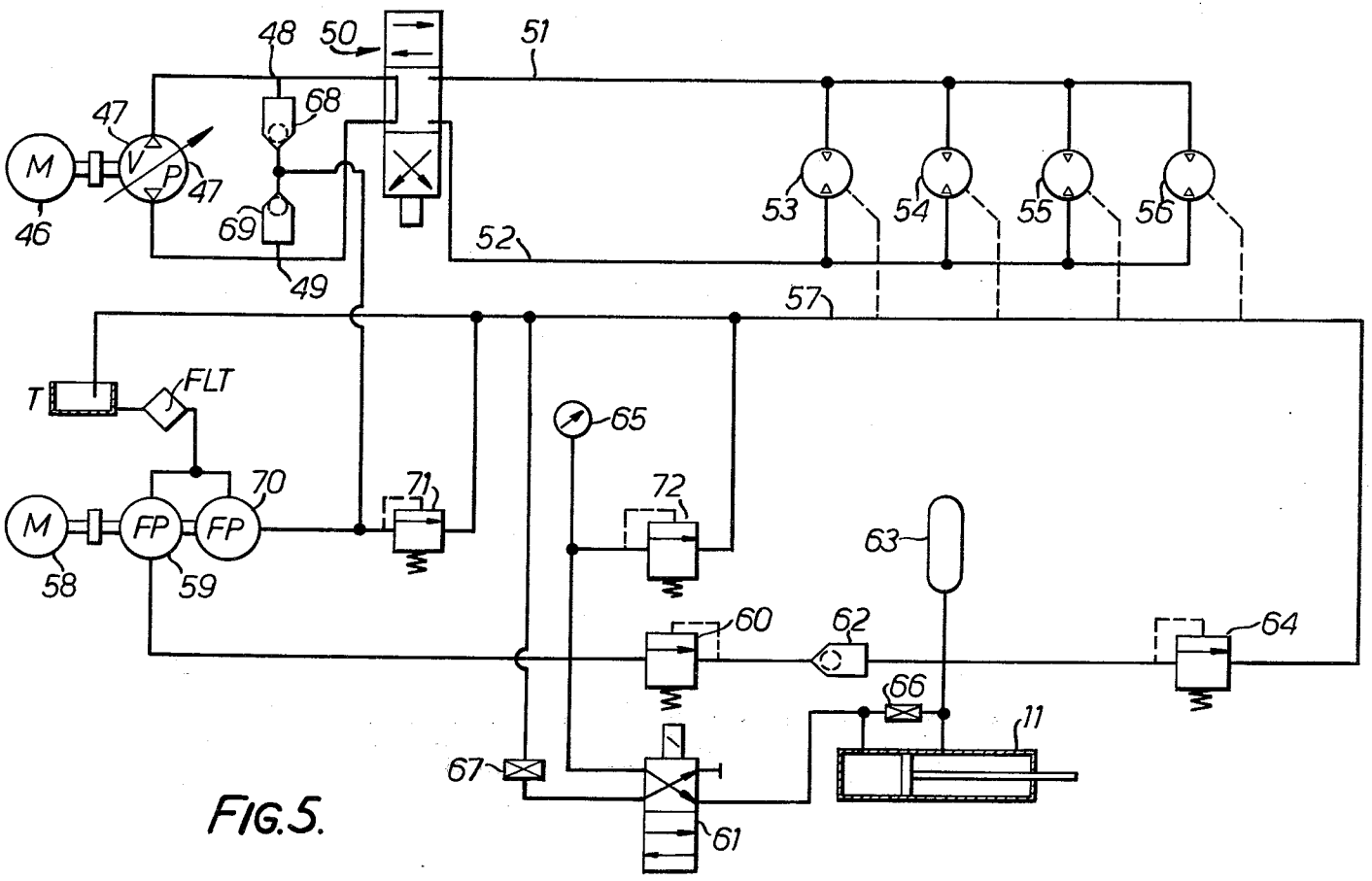
FIG. 5 shows the hydraulic circuit of the transporter.

FIG. 5 shows the hydraulic circuit of the cable transporter. A prime mover 46 drives a variable swash pump 47 the outputs of which are taken on lines 48, 49 to a selector valve 50 having FORWARD/STOP/-REVERSE positions. Lines 51, 52 taken from the selector valve 50 are connected in parallel to motors 53, 54, 55, 56 (two of which are of course the pictorially represented motors 21, 22, the other two not being seen pictorially). Leakage from the motors is returned to a drain line 57 connected to a tank T.

A further prime mover 58 drives two pumps, 59 and 70. The output at 59 is taken to a pressure reducing valve 60, and to a selector valve 61 having OPEN/-CLOSE POSITIONS. (It is shown in the open or wheels apart position). The pump 59 is connected to the tank T through a filter FLT. The pump's working pressure is set by relief valve 72. The ouput of the pressure-reducing valve 60 is connected through a non-return valve 62, to an accumulator 63 and to one side of the hydraulic ram 11. The junction of accumulator 63 and ram 11 is connected through a pressure-relief valve 64 to the drain line 57. The other side of ram 11 is supplied from or discharges through selector valve 61. A pressure meter 65 is connected to the output of pump 59. Valves 66 and 67 are manually operated valves, normally closed and open respectively. By reversing this sequence the wheels can be hydraulically locked open whatever position selected on valve 61.

The output of pump 70 is connected through two non-return valves 68 and 69 to provide boost supply to pump 47. Boost pressure is determined by the pressure relief valve 71. The disc brakes, if fitted, are hydraulically operated, but it is not considered necessary to show an hydraulic circuit for their operation.

It will easily be understood that it is desirable to support the cable in its entry and exit from the cable transporter and for this purpose a series of rollers at each end of the transporter defining a trough-shaped channel can be used. Rollers 73 shown diagrammatically in FIG. 2A illustrate this feature.

The above detailed description of the construction of the transporter will no doubt suffice to make its operation clear to the skilled reader but a few remarks on operation will now be given.

The selector valves 50 and 61 are set as shown so that the transporter is in a non-operative condition as shown in FIG. 2A. The cable to be hauled is positioned so as to lie on the axis 1 and selector valve 61 is changed to its other position. The ram 11 now draws the wheels into the FIG. 2 position in which they are resiliently biassed against the periphery of the cable. Selector valve 50 is set to FORWARD or REVERSE as desired and the hydraulic motors drive the wheels to haul the cable at a speed set by variable swash pump 47. To stop the transporter selector valve 50 is returned to the position shown and the brakes applied to hold the cable against any axial pull.

The cable transporter has several advantages which will now be discussed.

The mechanical inter-coupling of the wheels for conjoint motion enables the advantages of parallel hydraulic connection of motors to be retained (for example, lower pressure supply than) series connected motors and high torque) and enables chain to be hauled without the chain becoming "bunched-up" between wheel pairs. If for any reason (for example, a greasy surface area) one of the pairs of wheels loses frictional contact with the cable, the motors of those wheels can apply torque to the other pair through the mechanical intercoupling. Slip between wheels is prevented.

The use of pivoting bogies resiliently biassed together enables increases or decreases in cable diameter to be accommodated without loss of contact. If during the passage of a cable, through the transporter a shackle, for example, is received at the input end of the transporter so that the overall cable diameter is increased, the effect is that the first pair of opposed wheels are forced apart. The bogies pivot against the resiliency of the metalstik bearings and move apart against the resiliency of the hydraulic ram to allow the first pair of wheels to move apart. The first pair of opposed wheels exert an increased torque in attempting to pass the shackle which causes an increase in hydraulic pressure in the motor circuit and therefore increased torque at the other two wheels. Once the shackle has cleared the first pair of opposed wheels the boogies will return to their initial position until the shackle reaches the second pair of opposed wheels. The boogies will then pivot and move apart to pass the shackle through the second pair of opposed wheels.

Undesired pivotal movement of the bogies could cause unequal load-sharing but the placing of the bogie pivotal axes close to the cable surface is advantageous in ensuring that tractive effort is shared equally between the wheels. Ideally, the line of each pivotal axis passes through the cable path but this is not very convenient to achieve practically.

The opening of the transporter as shown in FIG. 2A when out of use, keeps the apparatus cut of the way of the cable during an actual laying operation.

The symmetrical construction of the transporter is advantageous in allowing forward and reverse operation with equal tension handling ability.

It will be understood that the described cable transporter can be modified in various ways and examples will now be given.

The provision of disc brakes is optional as in many cases the cable would not provide sufficient pull when stationary to render them necessary. Other types of brake or none could be used.

The use of sprockets and chains is an alternative to the use of intermediate gear wheels. Toothed belts or gear trains are other alternatives.

The use of meshing quadrants (see FIG. 4 of British specification 1,315,664) is an alternative to the sliding plate mechanism.

The motion of the bogies together and apart could be parallel instead of arcuate by mounting each bogie on a respective sliding carriage.

A pair of linear springs (one at each end at right angles to the cable path) could be used instead of the torsion bearing of each bogie.

The function of the hydraulic ram to draw the two bogies together could alternatively be achieved by a tension spring.

The wheels could alternatively be arranged in a vertical plane.

More pairs of wheels could be provided or two transporters worked in tandem fashion.

I claim:

1. An apparatus for hauling an elongate body such as a cable, the apparatus including:

a plurality of pairs of traction wheels, each pair being mounted tandem fashion relative to the other of the pairs so as to define a path for the elongate body, resilient wheel bias means to resiliently bias the wheels of each pair into contact with the elongate body on opposite sides of the axis thereof, which body is therefore gripped, in use, by the wheels, a plurality of motors to drive the traction wheels, each pair of traction wheels having at least one respective motor, and a mechanical coupling constraining one wheel of one pair to rotate conjointly with one wheel of another pair.

2. An apparatus as claimed in claim 1 in which the number of pairs of wheels is two.

3. An apparatus as claimed in claim 2 in which the mechanical coupling comprises a first intermediate gear wheel interconnecting the two wheels on one side of said path and a second intermediate gear wheel interconnecting the two wheels on the other side of said path.

4. An apparatus for hauling an elongate body such as a cable, the apparatus including:

two pairs of traction wheels each pair being mounted tandem fashion relative to the other pair so as to define a path for the elongate body, the wheels on one side of said path being mounted on a bogie mounted for pivotal movement about an axis parallel to the axis of the wheels, a plurality of motors to drive the traction wheels, each pair of traction wheels having at least one respective motor, and a mechanical coupling comprising a first intermediate gear wheel interconnecting the two wheels on one side of said path and a second intermediate gear wheel interconnecting the two wheels on the other side of said path.

5. An apparatus as claimed in claim 4 in which the wheels on the other side of the said path are mounted on another bogie mounted for pivotal movement about an axis parallel to the axes of the wheels.

6. An apparatus as claimed in claim 5 in which the distance of the pivot axis of each bogie from said path is small compared with the radii of the wheels.

7. An apparatus as claimed in claim 5 in which the bogies are resiliently biased to a position in which a line through the centers of the wheels of one bogie is parallel to a line through the centers of the wheels of the other bogie.

8. An apparatus as claimed in claim 7 in which each bogie is resiliently biased to said position by a respective torque member.

9. An apparatus as claimed in claim 8 in which each torque member comprises a rubber/metal bonded bush bearing.

10. An apparatus for hauling an elongate body such as a cable, the apparatus including a base, a pair of supports movably mounted on the base, two pairs of traction wheels, each pair being mounted tandem fashion relative to the other pair so as to define a path for the elongate body, one wheel of each pair being mounted on one support and the other wheel of each pair being mounted on the other support, the supports being mounted for movement towards and away from the path, resilient wheel bias means connected to each support to resiliently bias the wheels of each pair into contact with the elongate body on opposite sides of the axis thereof, which body is therefore gripped, in use, by the wheels, a plurality of motors to drive the traction wheels, and a mechanical coupling constraining said one wheel of one pair to rotate conjointly with said one wheel of the other pair.

11. An apparatus as claimed in claim 10 in which a respective motor is provided for each wheel.

12. An apparatus as claimed in claim 11 in which the motors are hydraulic motors hydraulically connected in parallel.

13. An apparatus as claimed in claim 10 in which the supports are pivotally mounted for movement towards and away from said path.

14. An apparatus as claimed in claim 10 in which means are provided to constrain the wheels for symmetrical movement towards and away from said path.

15. An apparatus as claimed in claim 14 in which the constraining means comprises a member mounted for sliding movement in the plane of symmetry in respect of said symmetrical movement and connected to each support by a respective pivotally mounted link arm.

16. An apparatus for hauling cable, the apparatus including a base, a pair of supports movably mounted on the base, two pairs of traction wheels, each pair being mounted tandem fashion relative to the other pair so as to define a path for the cable, a pair of bogies, each bogie being pivotally mounted on a respective support for pivotal movement about axis parallel to the axes of the wheels, the traction wheels of each bogie being coplanar, resilient wheel bias means connected to each support to resiliently bias the wheels of each pair into contact with a cable on opposite sides of the axis thereof, which cable is therefore gripped, in use, by the wheels, a plurality of hydraulic motors connected bydraulically in parallel, a respective motor being provided for each wheel, a first inermediate gear wheel interconnecting the two wheels on one side of the cable path, and a second intermediate gear wheel interconnecting the two wheels on the other side of the cable path.

17. An apparatus as claimed in claim 16 in which the resilient wheel bias means comprises an hydraulic jack connected from one support to the other.

* * * * *